US007055769B2

(12) United States Patent
Pierce

(10) Patent No.: US 7,055,769 B2
(45) **Date of Patent: *Jun. 6, 2006**

(54) COLLIDER

(76) Inventor: Melvin E. Pierce, P.O. Box 378, Semmes, AL (US) 36575

( * ) Notice: Subject to any disclaimer, the term of this patent is extended or adjusted under 35 U.S.C. 154(b) by 145 days.

This patent is subject to a terminal disclaimer.

(21) Appl. No.: 10/728,381

(22) Filed: Dec. 8, 2003

(65) Prior Publication Data

US 2005/0121549 A1 Jun. 9, 2005

(51) Int. Cl.
*B02C 13/20* (2006.01)
*B02C 13/00* (2006.01)
*B02C 1/10* (2006.01)

(52) U.S. Cl. ..... 241/187; 241/188.1; 241/275

(58) Field of Classification Search ..... 241/187, 241/188.1, 72, 275
See application file for complete search history.

(56) References Cited

U.S. PATENT DOCUMENTS

| | | | | | |
|---|---|---|---|---|---|
| 3,987,970 | A * | 10/1976 | Burkett | 241/43 |
| 4,166,583 | A * | 9/1979 | Ruckstuhl | 241/73 |
| 5,067,661 | A * | 11/1991 | Eide | 241/55 |
| 5,192,029 | A * | 3/1993 | Harris | 241/27 |
| 5,205,500 | A * | 4/1993 | Eide | 241/154 |
| 5,400,977 | A * | 3/1995 | Hayles, Jr. | 241/154 |
| 5,887,809 | A * | 3/1999 | Walters | 241/187 |
| 5,947,396 | A | 9/1999 | Pierce | |
| 5,954,281 | A * | 9/1999 | Hayles, Jr. | 241/187 |
| 6,669,125 | B1 * | 12/2003 | Howard | 241/187 |

* cited by examiner

*Primary Examiner*—Faye Francis
(74) *Attorney, Agent, or Firm*—Rodgers & Rodgers

(57) ABSTRACT

A material collider having a pair of rotor assemblies respectively housed within a pair of interconnected cylindrical chambers with a plurality of disc members secured thereto, at least one thrust guide secured to the disc members and a weir secured to the inner periphery of the cylindrical chambers.

5 Claims, 4 Drawing Sheets

COLLIDER

BACKGROUND OF THE INVENTION

The present invention is related to a material collider and more particularly to a material collider apparatus which can break down materials received into the apparatus, such as drill cuttings from a wellbore, to a reduced particle size for further use such as by reinjection of the refined cuttings down a wellbore. Drill cuttings are an inevitable by-product of well drilling and their disposal has been a longstanding problem. Offshore drilling operations, in particular, are problematic because of the need to transport the cuttings to a landfill or a shore-based processing system.

Depending on the results required of a particular collider application, particle size variations are often necessary. In order to adjust the particle size of the solids that are discharged from the collider, a variation in flow speed or retention time in the collider is required. The amount of time that solids are retained within the collider determines the particle size with a higher retention time resulting in smaller size particles.

BRIEF SUMMARY OF THE INVENTION

A material collider having a base frame with a housing assembly secured to the base frame and forming a pair of interconnected cylindrical chambers. A pair of coaxially related rotor assemblies extending parallel through the chambers and having a plurality of disc members secured thereto in which the disc members are disposed transverse to the axis of the chambers and have at least one thrust guide secured to the disc member. A weir is secured to the inner periphery of the cylindrical chambers so as to slow the rate of flow and increase retention time of the material flowing through the collider.

DETAILED DESCRIPTION OF THE INVENTION

Figure 1:
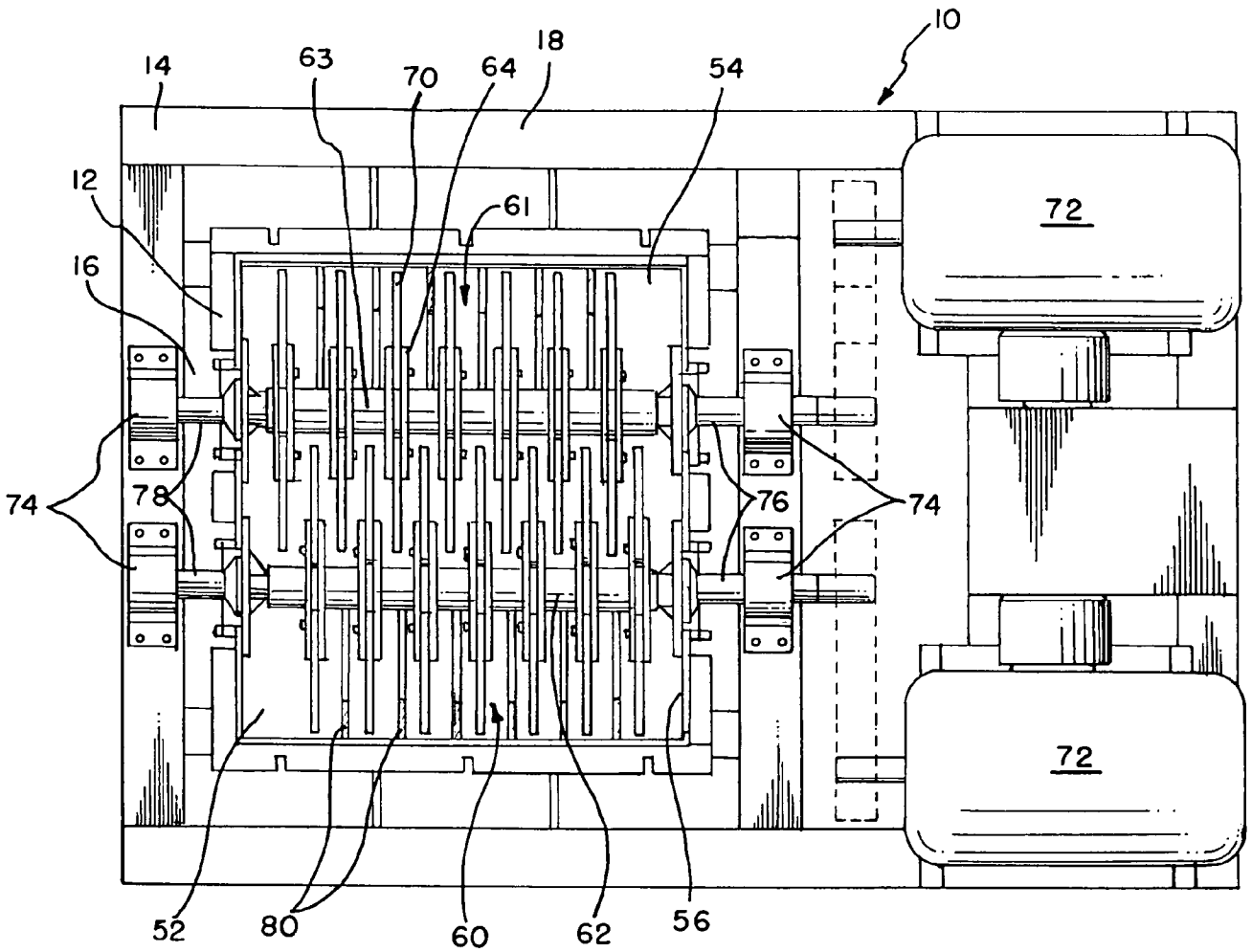
FIG. 1 is a top view of the collider of the present invention with the top cover removed.

In the drawings, there is provided a material collider generally indicated by the numeral 10 including a housing assembly 12 securely mounted to a base frame assembly 14. The housing 12 and base frame 14 assemblies may be formed of structural steel, for example, and the housing assembly 12 is secured to the base frame assembly 14 so as to rest partially within a cavity 16 in the base frame assembly 14. The base frame assembly 14 is provided with support beams 18 which are at least eighteen inches in height to provide balance and stability as well as to reduce vibration during operation of the collider.

Figure 2:
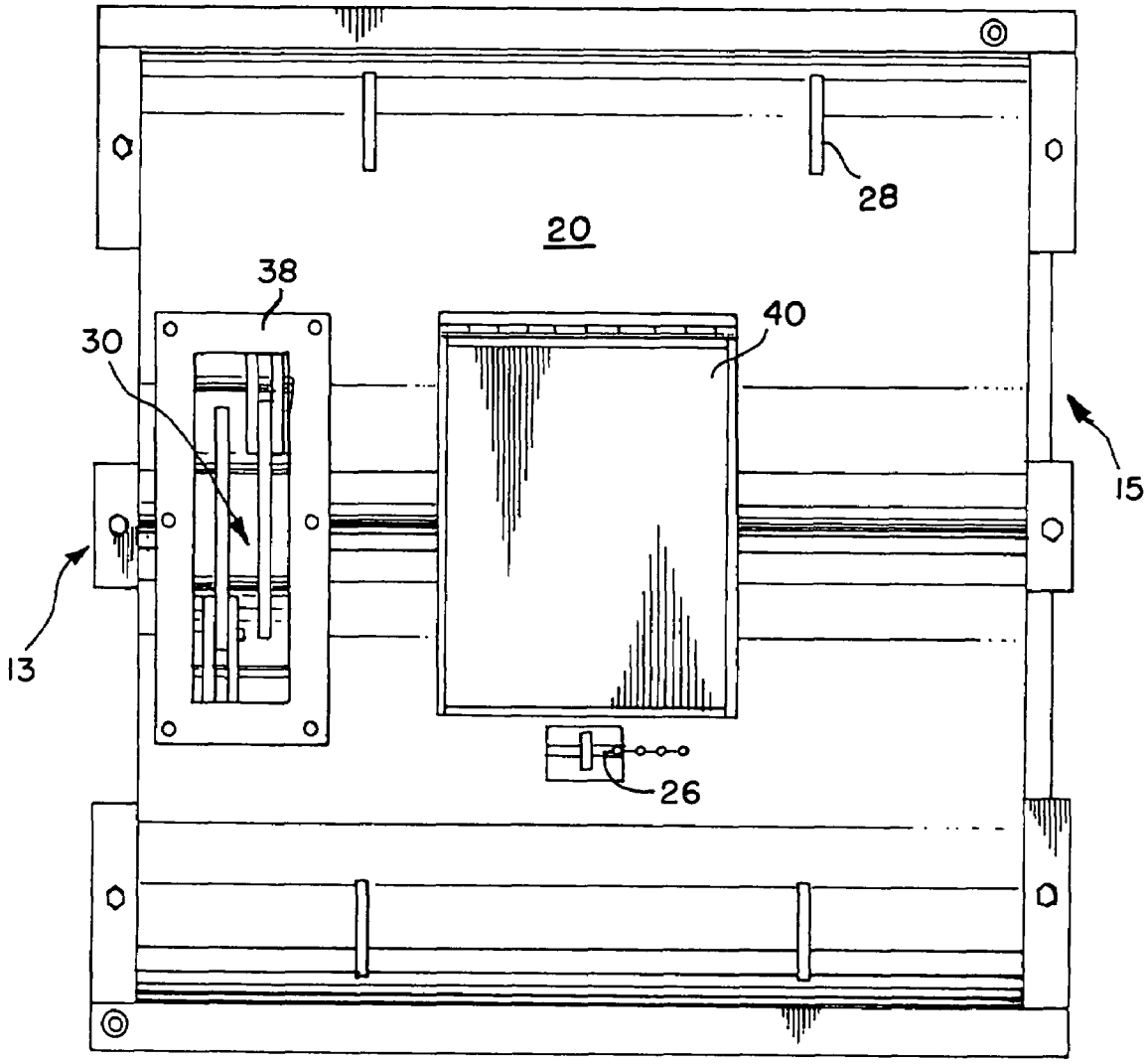
FIG. 2 is a top plan view of the housing assembly of the present invention.
Figure 3:
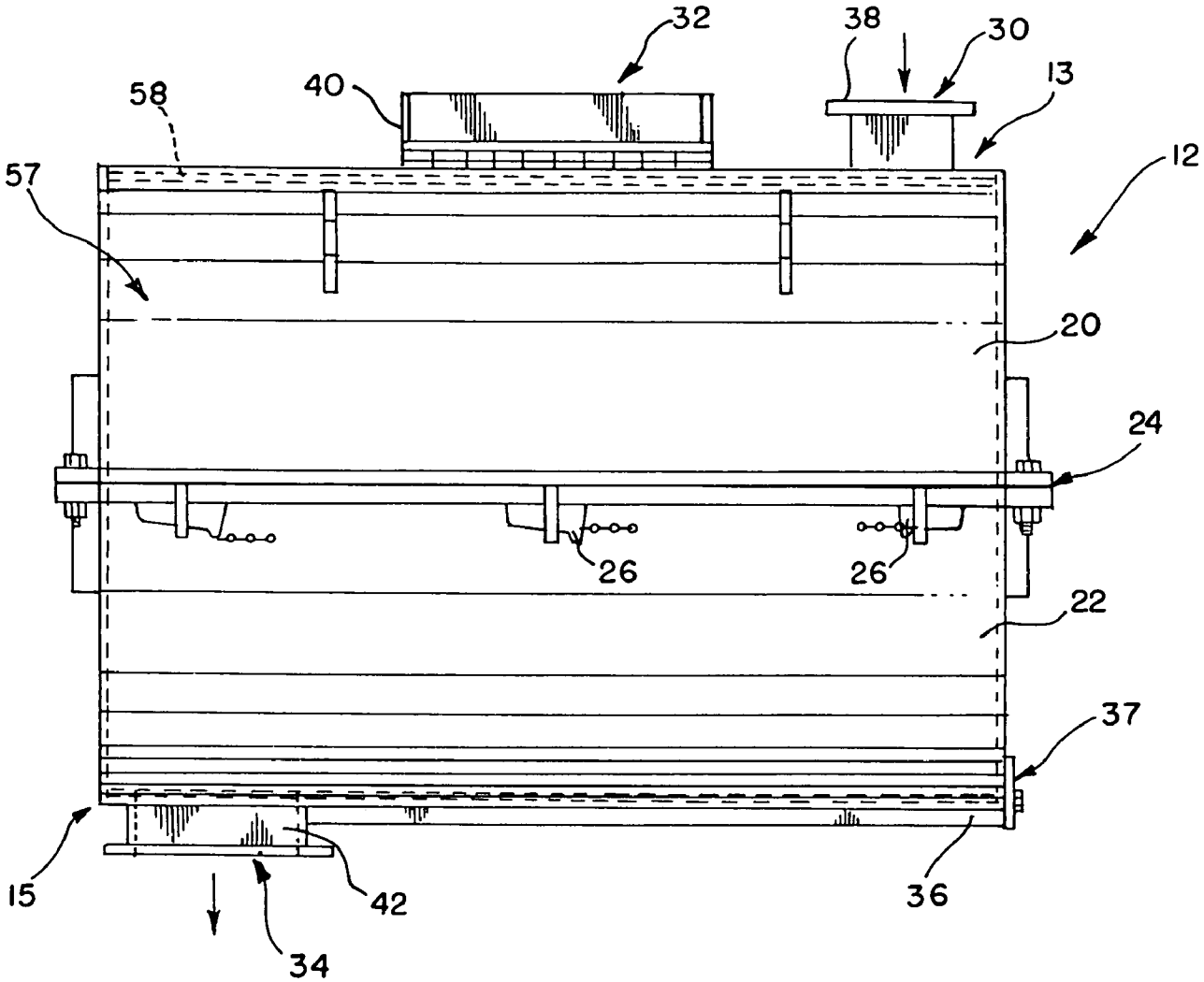
FIG. 3 is a front elevational view of the housing assembly of the present invention.
Figure 4:
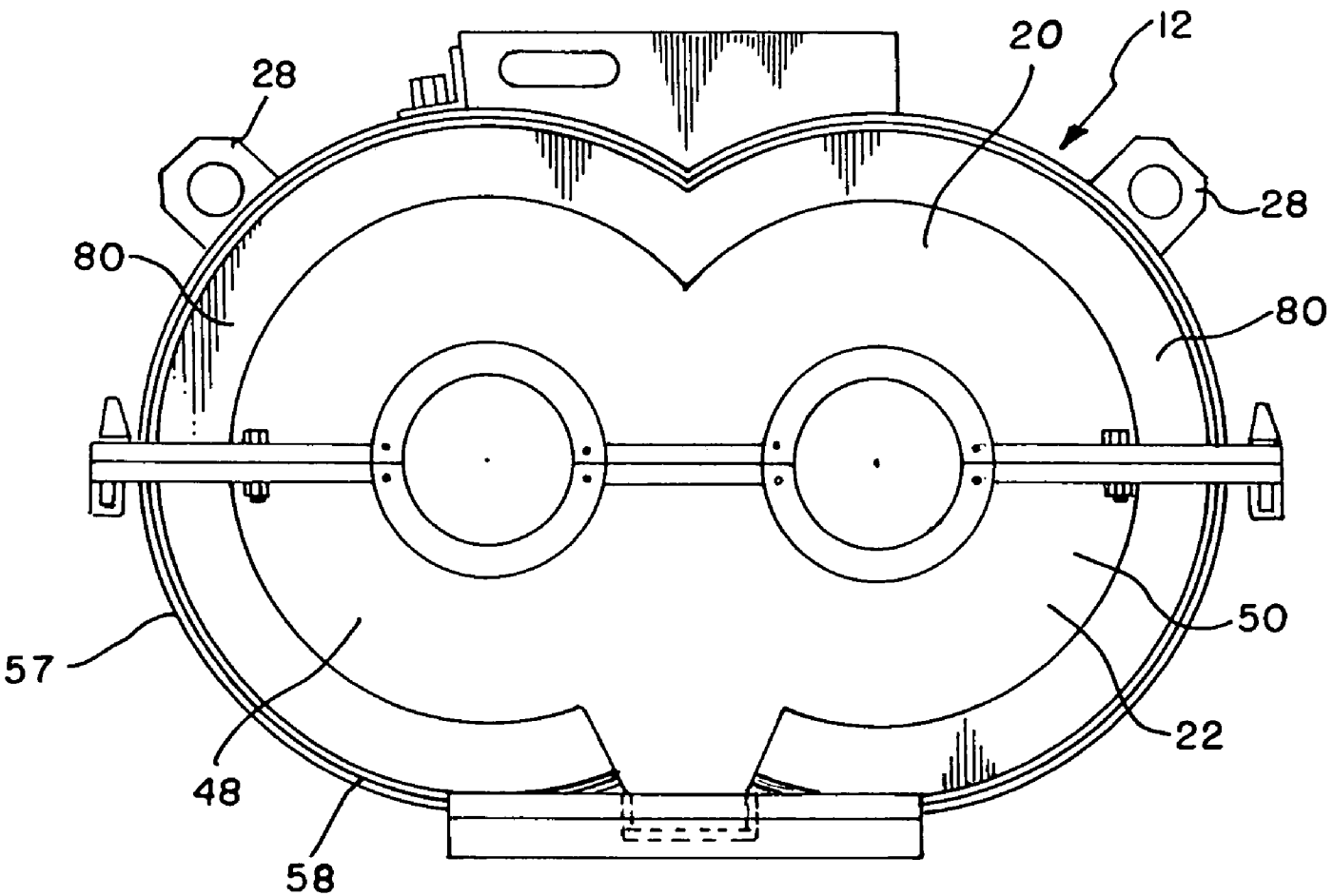
FIG. 4 is a right side elevational view of the housing assembly of the present invention.

As shown in FIGS. 2 and 4, housing assembly 12 is formed of a two-piece construction, including a top section 20 and a bottom section 22 so as to allow the top section to be removed in circumstances requiring cleaning or replacing of components within the housing assembly 12. A sealing member 24 is positioned between top 20 and bottom 22 sections of the housing assembly and cooperates with wedgelocks 26 to securely maintain the top 20 and bottom 22 sections together. Lifting eyes 28 are provided on the top section 20 of the housing assembly 12 to allow the top section of the housing assembly to be removed, such as by a jib hoist, for example.

The housing assembly top section 20 has a feed inlet opening 30 and an inspection opening 32 and the bottom section 22 includes a material discharge opening 34 and a clean out trough 36. A feed inlet chute 38 and an inspection door 40 are secured to the top section 20 above the feed inlet 30 and inspection openings 32, respectively. A material discharge outlet 42 is secured to the bottom section 22 below the discharge opening 34.

Feed inlet chute 38 is sufficiently large to allow collider 10 to receive materials of widely varying sizes, wet or dry, and is provided with an input port for receiving water injection. The material outlet 42 is sufficiently large to allow as much material to be discharged as is fed into the collider 10. Inspection door 40 is hingedly secured to top section 20 and maintained in place by a wedgelock 26. Inspection door 40 permits an operator to view the housing interior without having to remove the housing top section 20. Feed inlet chute 38 and material outlet 42 may be secured to the housing by traditional means such as by bolts, welding or the like.

As shown in FIG. 4, when top 20 and bottom 22 sections of the housing assembly are secured together, the housing assembly generally indicated by the numeral 12 takes the form of a pair of overlapping cylindrical tanks 48 and 50 having substantially a figure eight shape in cross section, thus providing respective housing chambers 52 and 54 which are in fluid communication. Housing assembly internal wall 56 may be lined with replaceable wear liners or wear plates 58 which are of harder grade steel than the housing assembly for preventing damage to the housing internal 56 and external 57 walls during operation of the collider. Wear plates 58 may be secured to the housing assembly interior by bolts, for example.

As shown in FIG. 1, a pair of rotor assemblies generally indicated by the numerals 60 and 61 are maintained within housing assembly 12 and cooperate to force materials fed into the feed inlet to collide with one another and produce a finely ground material which is then dispensed through the material outlet. Each rotor assembly 60 and 61 includes rotors 62 and 63, respectively, which are axially positioned within a respective housing chamber 52 and 54 so as to extend in parallel relation to one another throughout the length of the chambers 52 and 54. As shown in FIG. 1, rotor assemblies 60 and 61 are also provided with an easily maintainable and interchangeable system of disc sets 64 and thrust guides 70, wherein the disc sets are mounted at evenly spaced intervals along the length of each rotor 62 and 63.

Thrust guides 70 are held rigidly between disc sets 64 so as to maintain full extension and thereby rotate as closely as possible to the housing internal wall 56 or the wear plates 58. By rotating in close proximity to the housing internal wall 56 or the wear plates 58, the thrust guides 70 are unlikely to miss materials or particles which have become positioned along the housing internal walls and which could be missed by a thrust guide which has folded back during operation.

Rotor assemblies 60 and 61 are freely rotatable in either direction and during operation of the material collider 10 will rotate in opposite or counterrotating directions with respect to each other. Thrust guides 70 may be of equal length as well as of equal weight. Alternatively, thrust guides 70 may vary in length and weight. For proper balance, however, opposing thrust guides on the same disc set are preferably the same length and weight.

As shown in FIG. 1, a drive system including motors 72, bearings 74, drive shafts 76 and stub shafts 78 is mounted to the base frame assembly 14 to rotate the rotor assemblies 60 and 61. Drive shafts 76 and stub shafts 78 are rotatably mounted within bearings 74 and are axially aligned with and coupled to an associated rotor assembly 60 and 61. Bearings 74 are securely mounted to base frame 14.

As best shown in FIGS. 1 and 4 and in accordance with this invention, multiple flow weirs 80 are secured to the inner wall 56 or wear plates 58 such as by means of welding and the like. Flow weirs 80 are approximately ¼ inch thick and are positioned adjacent the discharge side of the respective thrust guide 70 and spaced approximately ¼ to one inch therefrom. Flow weirs 80 extend around the periphery of the internal periphery of housing chambers 52 and 54 and extend inwardly therefrom the distance from one to six inches. A varying number of weirs can be utilized in the collider, and, as the number of weirs increases, the flow rate of the particles is decreased. Additionally, as the width of an individual weir is increased incrementally from one to six inches the flow rate is also caused to decrease. By increasing the retention time of the particles being processed, a reduced particle size results. Therefore, in accordance with a particular application and particle size requirement, manipulation in the number and size of the weirs in combination results in the desired size of the particles discharged from the collider.

In operation, material such as drill cuttings from a wellbore is fed into the collider 10 in slurry form through the feed inlet chute 38 at the top of the feed end 13 of the housing assembly where it is mixed with water and injected through an input port in the feed inlet chute. Once inside the housing assembly, the particles contained in the drill cuttings are broken up by continual collisions with one another, caused by the action of the counter rotating shafts 76 which turn the rotor assemblies 60 and 61 and thereby the disc sets 64 in opposite rotational relation so that the thrust guides 70 carried by rotor assembly 60 interengage with the thrust guides 70 on the other rotor assembly 61 in an overlapping manner.

The action of the thrust guides 70 spins the slurry materials, and forces the slurry solid particles to collide with one another so as to break into smaller pieces. This process continues until the material reaches the material discharge 34 where it then flows out of the chambers 52 and 54 to be used for reinjection into the wellbore. The intermeshing of the thrust guides 70 and their positioning on the disc sets 64 of each shaft 60 and 61 act to properly balance the collider 10 when in use so that vibration of the collider 10 is minimal. Also the flow rate of the material is controlled by means of a variation in the number and size of flow weirs 80.

I claim:

1. A material collider apparatus for producing finely ground material comprising a base frame assembly including a housing cavity, a housing assembly secured to said base frame assembly so as to rest at least partially within said base frame housing cavity, said housing assembly being formed by a pair of interconnected cylindrical chambers which are in fluid communication and in overlapping relation along the length thereof, a pair of rotor assemblies each having a rotor, with one rotor being rotatably maintained coaxially in each cylindrical chamber, said rotors extending in parallel relation throughout the length of the chambers, each rotor assembly further including a plurality of disc members secured to each rotor, said disc members extending generally transverse to the longitudinal axis of the chambers, and at least one thrust guide member in the form of an elongated bar or rod rigidly secured to at least one disc member, at least one flow weir secured to the inner periphery of at least one of said cylindrical chambers, means for rotating said rotor assemblies, said flow weir being disposed adjacent the discharge side of said thrust guide, and said flow weir being spaced ¼ to one inch from said thrust guide.

2. An apparatus according to claim 1 wherein at least one flow weir is secured to the inner periphery of each of said cylindrical chambers.

3. An apparatus according to claim 1 wherein multiple flow weirs are secured to inner peripheries of said cylindrical chambers.

4. An apparatus according to claim 1 wherein said flow weirs are approximately one to six inches in width.

5. An apparatus according to claim 1 wherein said flow weir is approximately ¼ inch thick.

* * * * *